US010948268B2

(12) United States Patent
Krueger

(10) Patent No.: US 10,948,268 B2
(45) Date of Patent: Mar. 16, 2021

(54) SAFETY DEVICES AND METHODS OF USING A SAFETY DEVICE

(71) Applicant: Victoris LLC, Sylvania, OH (US)

(72) Inventor: David Krueger, Sylvania, OH (US)

(73) Assignee: Victoris LLC, Sylvania, OH (US)

( * ) Notice: Subject to any disclaimer, the term of this patent is extended or adjusted under 35 U.S.C. 154(b) by 0 days.

(21) Appl. No.: 16/595,691

(22) Filed: Oct. 8, 2019

(65) Prior Publication Data

US 2020/0109923 A1 Apr. 9, 2020

Related U.S. Application Data

(60) Provisional application No. 62/743,193, filed on Oct. 9, 2018.

(51) Int. Cl.

| | |
|---|---|
| ***F41H 9/10*** | (2006.01) |
| ***G08B 15/00*** | (2006.01) |
| ***G08B 15/02*** | (2006.01) |

(52) U.S. Cl.

CPC ..... *F41H 9/10* (2013.01); *G08B 15/004* (2013.01); *G08B 15/02* (2013.01)

(58) Field of Classification Search

CPC ..... F41H 9/10; G08B 15/004; G08B 15/02
See application file for complete search history.

(56) References Cited

U.S. PATENT DOCUMENTS

| | | | | |
|---|---|---|---|---|
| 2,629,516 | A * | 2/1953 | Badham | F21V 33/0064 222/79 |
| 4,067,290 | A | 1/1978 | Hartley | |
| 5,635,908 | A | 6/1997 | Soper | |
| 5,859,588 | A | 1/1999 | Malone et al. | |
| 6,292,101 | B1 * | 9/2001 | Stoltz | E05B 73/0017 109/29 |
| 9,927,213 | B2 | 3/2018 | Komperda | |
| 2004/0051641 | A1 | 3/2004 | Fordyce et al. | |
| 2008/0098966 | A1 * | 5/2008 | Knoblach | A01K 13/006 119/855 |
| 2011/0056989 | A1 | 3/2011 | Ceja | |
| 2019/0271527 | A1 * | 9/2019 | Nangunoori | F41H 9/10 |

* cited by examiner

*Primary Examiner* — Donnell A Long
(74) *Attorney, Agent, or Firm* — MacMillan, Sobanski & Todd, LLC

(57) ABSTRACT

An example safety device includes a storage member, a membrane disposed within the chamber, a material disposed within the membrane, and an actuator moveably attached to the membrane. The storage member has a main body that defines a first opening, a chamber, and a windowed portion. Each of the first opening and the windowed portion provides access between the chamber and an environment exterior to the chamber. The membrane has a first configuration and a second configuration. The material is contained within the membrane when the membrane is in the first configuration and is in fluid communication with the environment exterior to the membrane when the membrane is in the second configuration. The actuator is moveable between a first position and a second position such that movement of the actuator results in movement of the membrane from the first configuration to the second configuration.

20 Claims, 12 Drawing Sheets

SAFETY DEVICES AND METHODS OF USING A SAFETY DEVICE

RELATED APPLICATION

This application claims the benefit of U.S. Provisional Application No. 62/743,193, filed on Oct. 9, 2018. The entire disclosure of this related application is hereby incorporated into this disclosure by reference.

FIELD

The disclosure relates generally to the field of personal safety. More particularly, the disclosure relates to safety devices and methods of using a safety device.

BACKGROUND

Self-defense devices have become a necessity for many individuals. Some examples of self-defense devices include bulky pressurized canisters that are handheld contain an irritant, which is sprayed from the canister. Unfortunately, handheld pressurized devices suffer various drawbacks. For example, they can be bulky and their design requires that they be grasped in the hand of the individual and directly oriented toward an assailant during use. As a result, the devices are often stored in an individual's pocket or purse, which requires that the device be located and removed from where it has been stored when the individual is presented with a threat. This process consumes time and can be difficult, especially when an individual is involved in a confrontation. Moreover, once extracted, the individual presented with the threat is further required to orient the device such that any substance emitted is directed toward the assailant. This action is also time consuming and difficult when one has only moments to react.

Therefore, a need exists for improved safety devices and methods of using a safety device.

SUMMARY

Various example safety devices and methods of using a safety device are described herein.

An example safety device includes a storage member, a membrane, a material disposed within the membrane, and an actuator attached to the membrane. The storage member has a main body that defines a first opening, a chamber, and a windowed portion. The first opening provides access between the chamber and an environment exterior to the chamber. The windowed portion extends through the main body and provides access between the chamber and the environment exterior to the chamber. The membrane is disposed within the chamber and has a first configuration and a second configuration. The material is contained within the membrane when the membrane is in the first configuration and is in fluid communication with the environment exterior to the chamber when the membrane is in the second configuration. The actuator is disposed within the chamber and is moveable between a first position and a second position such that movement of the actuator from the first position to the second position results in movement of the membrane from the first configuration to the second configuration.

Another example safety device includes a storage member, a membrane, a material disposed within the membrane, and an actuator attached to the membrane. The storage member has a main body that defines a first opening, a chamber, and a windowed portion. The first opening provides access between the chamber and an environment exterior to the chamber. The windowed portion extends through the main body and provides access between the chamber and the environment exterior to the chamber. The windowed portion defines a plurality of openings that extend through the main body. The membrane is releasably attached to the main body of the storage member and is disposed within the chamber. The membrane has a first configuration and a second configuration. The material is contained within the membrane when the membrane is in the first configuration and is in fluid communication with the environment exterior to the membrane when the membrane is in the second configuration. The actuator is partially disposed within the chamber and is moveable between a first position and a second position such that movement of the actuator from the first position to the second position results in movement of the membrane from the first configuration to the second configuration.

Another example safety device includes a storage member, a membrane, a material disposed within the membrane, and an actuator moveably attached to the membrane. The storage member has a main body that defines a first opening, a second opening, a chamber, and a windowed portion. The first opening provides access between the chamber and an environment exterior to the chamber. The second opening provides access between the chamber and the environment exterior to the chamber. The windowed portion extends through the main body and provides access between the chamber and the environment exterior to the chamber. The windowed portion defines a plurality of openings that extend through the main body. The membrane is releasably attached to the main body of the storage member and is entirely disposed within the chamber. The membrane has a first configuration and a second configuration. The material is contained within the membrane when the membrane is in the first configuration and is in fluid communication with the environment exterior to the membrane when the membrane is in the second configuration. The material includes a dye. The actuator is partially disposed within the chamber and is moveable between a first position and a second position such that movement of the actuator from the first position to the second position results in movement of the membrane from the first configuration to the second configuration. The actuator extends through the second opening.

An example method of using a safety device comprises: obtaining a safety device; attaching the safety device to an individual; conducting an activity; activating a first portion of the safety device; activating a second portion of the safety device; removing any material disposed on the individual subsequent to the step of activating the first portion of the safety device; removing the safety device from the individual; removing a first membrane from the safety device; and introducing a second membrane into the safety device.

Additional understanding of the example safety devices and associated methods can be obtained by review of the detailed description, below, and the appended drawings.

DETAILED DESCRIPTION

The following detailed description and the appended drawings describe and illustrate various example safety devices and methods of using a safety device. The description and illustration of these examples are provided to enable one skilled in the art to make and use a safety device and to practice a method of using a safety device. They are not intended to limit the scope of the claims in any manner.

Figure 1:
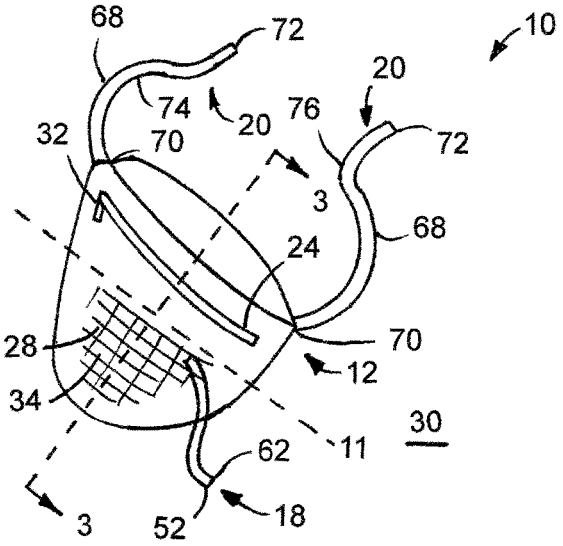
FIG. 1 is a perspective view of a first example safety device in a first configuration.
Figure 2:
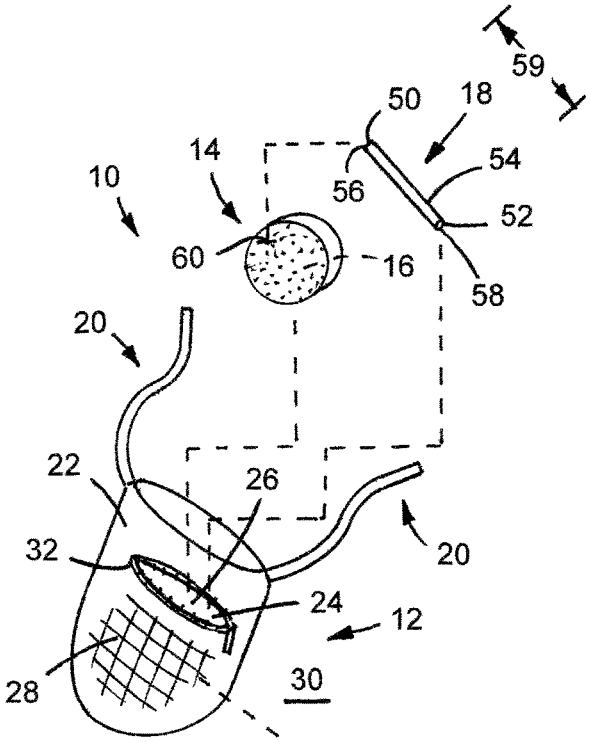
FIG. 2 is an exploded view of the safety device illustrated in FIG. 1.
Figure 3:
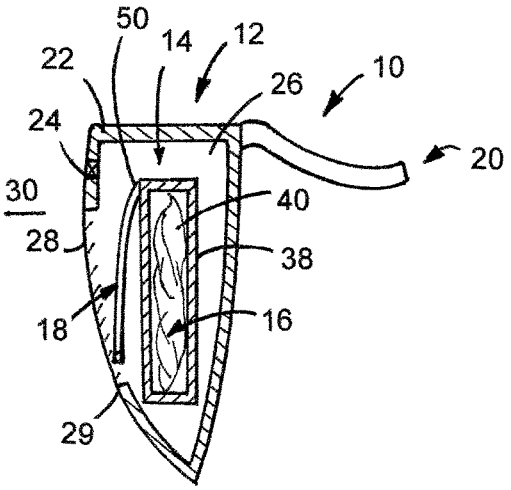
FIG. 3 is a cross-sectional view of the safety device illustrated in FIG. 1 taken along line 3-3.
Figure 4:
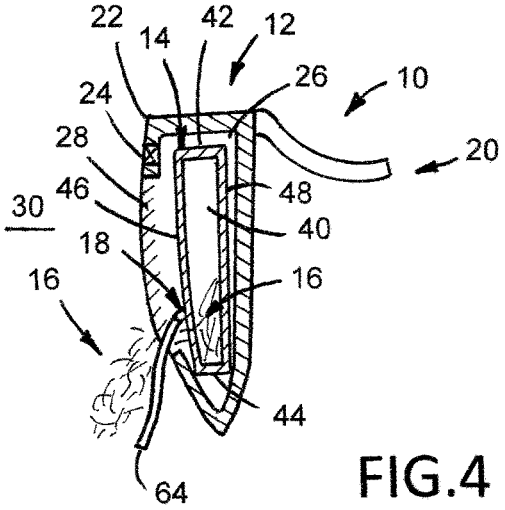
FIG. 4 illustrates the safety device shown in FIG. 3 in a second configuration.

FIGS. 1, 2, 3, and 4 illustrate a first example safety device 10 that is attachable to an individual and moveable between a first configuration, as shown in FIGS. 1 and 3, and a second configuration, as shown in FIG. 4. The safety device 10 has a lengthwise axis 11, a storage member 12, a membrane 14 disposed within the storage member 12, a material 16 disposed within the membrane 14, an actuator 18, and attachment members 20. In the illustrated embodiment, the safety device 10 is attachable to the waist of an individual.

In the illustrated embodiment, the storage member 12 has a main body 22 that defines a first opening 24, a chamber 26, and a windowed portion 28. The first opening 24 provides access between the chamber 26 and an environment 30 exterior to the chamber 26. The first opening 24 is sized and configured to allow the membrane 14 to be passed through the first opening 24 from the environment 30 exterior to the chamber 26 and into the chamber 26, and vice versa. The first opening 24 is moveable between an open configuration, as shown in FIG. 2, and a closed configuration, as shown in FIG. 1. The chamber 26 is sized and configured to receive the membrane 14 and the actuator 18 (e.g., a portion of the actuator). The windowed portion 28 extends through the main body 22 and provides access between the chamber 26 and the environment 30 exterior to the chamber 26. Each of the windowed portion 28 and the first opening 24 is positioned on the same side 29 of the storage member 12 (e.g., the front face of the storage member 12).

The storage member 12 can be formed of any suitable material and manufactured using any suitable technique or method of manufacture. Selection of a suitable material and of a suitable technique or method of manufacture can be based on various considerations, including the type of material disposed within a membrane intended to be stored within a storage member. Examples of materials considered suitable to form a storage member include rigid materials, flexible materials, textile materials, stain resistant materials, combinations of the materials described herein, and any other material considered suitable for a particular embodiment. Examples of techniques and methods of manufacture considered suitable to form a storage member include conventional manufacturing methods and techniques, and any other technique or method of manufacture considered suitable for a particular embodiment.

Any suitable structure can be included on a storage member to accomplish movement of an opening, such as a first opening, between an open configuration and a closed configuration and selection of a suitable structure can be based on various considerations, including the material that forms a storage member. Examples of structures considered suitable to include on a storage member to accomplish movement of an opening, such as a first opening, between open and closed configurations include zippers, hook and loop fasteners, buttons, and any other structure considered suitable for a particular embodiment. In the illustrated embodiment, the first opening 24 is moveable between open and closed configurations using a zipper 32 attached to the storage member 12.

The windowed portion 28 can comprise any structural configuration capable of providing fluid communication between the chamber 26 and the environment 30 exterior to the chamber 26 through the main body 22 of the storage member 12. Selection of a suitable structural configuration can be based on various considerations, including the material that forms a storage member. Examples of structural configurations considered suitable to form a windowed portion on a storage member include forming a portion of a main body of a storage member of a mesh of material, attaching a mesh of material to a main body of a storage member, forming (e.g., cutting) one or more slots within a material forming a storage member, forming (e.g., cutting) one or more, or a plurality of, openings through a material forming a storage member, including a grommet within each opening, or one or more openings, formed in a main body of a storage member, and any other structural configuration considered suitable for a particular embodiment. In the illustrated embodiment, the windowed portion 28 is formed as a mesh of material 34 in the material forming the storage member 12.

In the illustrated embodiment, the membrane 14 is disposed within the chamber 26 such that it is housed by the storage member 12. The membrane 14 has a main body 38 that defines a chamber 40, a top 42, a bottom 44, a first side 46, and a second side 48. The membrane 14 has a first configuration, as shown in FIGS. 1, 2, and 3, in which the chamber 40 seals the material 16 within the chamber 40, and a second configuration, as shown in FIG. 4, in which the chamber 40 is in fluid communication with the chamber 26 and the environment 30 exterior to the chamber 26. The safety device 10 is in the first configuration when the membrane 14 is in the first configuration and the safety device 10 is in the second configuration when the membrane 14 is in the second configuration. The membrane 14 is not directly attached to the main body 22 of the storage member 12. However, alternative embodiments, such as those described herein, can include a membrane that is directly attached to a storage member.

A membrane 14 can be moved from a first configuration to a second configuration using any suitable technique or method and selection of a suitable technique or method can be based on various considerations, such as the material that forms a membrane and/or the type of actuator included in a safety device. Examples of techniques and methods of moving a membrane from a first configuration to a second configuration include tearing, ripping, damaging, poking, combinations of the techniques and methods described herein, and any other technique or method considered suitable for a particular embodiment.

The main body 38 of the membrane 14 can be formed of any suitable material and have any suitable configuration. Selection of a suitable material and configuration for a main body of a membrane can be based on various considerations, including the material intended to be stored within a membrane. Examples of materials considered suitable to form a main body of a membrane include rigid materials, such as metals and alloys, flexible materials, plastics, thin-film plastics, polymers, silicone, polyethylene, low density polyethylene, polypropylene, polypropylene resin, combinations of the materials described herein, and any other material considered suitable for a particular embodiment. Examples of configurations considered suitable for a main body of a membrane include cylindrical, cuboidal, and any other configuration considered suitable for a particular embodiment. Examples of methods and techniques considered suitable to fabricate a membrane include extrusion processes, molding processes, injection molding processes, and any other method or technique considered suitable for a particular embodiment. In the illustrated embodiment, the main body 38 of the membrane 14 is formed of a first material, the storage member 12 is formed of a second material, and the actuator 18 is formed of a third material. The first material is different than the second material and the third material and the second material is different than the third material. The first material is a plastic and the membrane 14 has a cylindrical configuration.

While the membrane 14 has been illustrated as entirely disposed within the chamber 26 and as not being directly attached to the storage member 12, any suitable portion of a membrane can be disposed within a chamber and a membrane can be attached to a storage member in any suitable manner. Selection of a suitable portion of a membrane to position within a chamber and of a suitable method of attaching a membrane to a storage member can be based on various considerations, including the intended use of a safety device of which the membrane is included. Examples of portions of a membrane considered suitable to position within a chamber of a storage member include the entire membrane, a portion of a membrane, and any other portion considered suitable for a particular embodiment. Examples of types of attachment considered suitable between a storage member and a membrane include releasable attachments (e.g., using hook and loop attachments, zippers, adhesives), fixable attachments, direct attachments, indirect attachments, combinations of the attachments described herein, and any other attachment considered suitable for a particular embodiment.

In the illustrated embodiment, the material 16 is disposed within the chamber 40 defined by the membrane 14. The material 16 is contained within the membrane 14 when the membrane 14 is in the first configuration and the material 16 is in fluid communication with the chamber 26 and the environment 30 exterior to the membrane 14 when the membrane 14 is in the second configuration. The material 16 can comprise any suitable material and selection of a suitable material to include in a chamber defined by a membrane can be based on various considerations, including the intended use of a safety device of which the material is included. Examples of materials considered suitable to include in a chamber defined by a membrane include powders, dusts, such as fingerprint dust, fluids, liquids, gels, viscous materials, viscous flowable materials, high viscosity materials, high viscosity fluids, dyes, ultra-violet (UV) materials that are visible under UV lights, such as UV dyes, volatile materials, irritants, materials that are irritants to a human nose, irritants to a human eye, ammonium sulfide, urine, wild animal urine, such as skunk urine, wild animal scent, such as skunk spray, materials that are resistant to freezing, materials that are diluted, materials that are highly visible using the human eye, materials that are visible using a viewing device, pressurized materials, combinations of the materials described herein, and any other material considered suitable for a particular embodiment. For example, a material disposed within a chamber defined by a membrane can be selected from the group consisting of dyes, irritants, or urine. As used herein, the term "irritant" means any substance, in any form (e.g., powder, liquid, gas), that results in irritation to an individual (e.g., human) when the individual is near, around, or in contact with the substance. A material disposed within a chamber defined by a membrane can have any suitable viscosity and selection of a suitable viscosity for a material disposed within a chamber of a membrane can be based on various considerations, including the intended use of a safety device of which the material is included. In the illustrated embodiment, the material 16 comprises a liquid that includes a dye.

In the illustrated embodiment, the actuator 18 is directly attached to the membrane 14, is partially disposed within the chamber 26, and is moveable between a first position, as shown in FIG. 3, and a second position, as shown in FIG. 4, such that movement of the actuator 18 from the first position to the second position results in movement of the membrane 14 from its first configuration to its second position. The actuator 18 has a first end 50 attached to the membrane 14 and a second end 52.

An actuator 18 included in a safety device can comprise any suitable device, feature, or component capable of moving a membrane from a first configuration to a second configuration and selection of a suitable actuator to include in a safety device can be based on various considerations, including the material that forms a membrane. Examples of actuators considered suitable to include in a safety device include actuators that are directly attached to a membrane, actuators that are indirectly attached to a membrane, actuators that are fixedly attached to a membrane, actuators that are releasably attached to a membrane, an elongate member, an elongate member directly attached to a membrane, an elongate member indirectly attached to a membrane, buttons, buttons that include piercing elements, buttons disposed partially, or entirety, within a chamber defined by a storage member, moveable members, combinations of the actuators described herein, and any other actuator considered suitable for a particular embodiment. In the illustrated embodiment, the actuator 18 is an elongate member 54 that has a first end 56, a second end 58, and a length 59. The first end 56 is directly attached to the membrane 14 at location 60. The location 60 is disposed closer to the top 42 of the membrane 14 than the bottom 44 of the membrane 14 and is on the first side 46 of the membrane 14. The elongate member 54 extends from the first end 56, through the windowed portion 28, to the second end 58 such that it extends through the windowed portion 28. However, alternative embodiments can include an actuator that is not directly attached to a membrane and/or that extends through a separate opening created through a main body of a storage member.

In the first position, the second end 52 of the actuator 18 is disposed at a first location 62 relative to the lengthwise axis 11 of the safety device 10. In the second position, the second end 52 of the actuator 18 is disposed at a second location 64 relative to the lengthwise axis 11 of the safety device 10, which is different than the first location 62. In the illustrated embodiment, the first location 62 is disposed a first distance from the storage member 12 and the second location 64 is disposed a second distance from the storage member 12 that is greater than the first distance.

The actuator 18 can be formed of any suitable material and manufactured using any suitable technique or method of manufacture. Selection of a suitable material and of a suitable technique or method of manufacture can be based on various considerations, including the material that forms an actuator. Examples of materials considered suitable to form an actuator include rigid materials, metals, alloys, flexible materials, stain resistant materials, combinations of the materials described herein, and any other material considered suitable for a particular embodiment. Examples of techniques and methods of manufacture considered suitable to form an actuator include conventional manufacturing methods and techniques, and any other technique or method of manufacture considered suitable for a particular embodiment. In the illustrated embodiment, the actuator 18 is formed of a weaved material. While the actuator 18 has been illustrated as being partially disposed within the chamber 26, an actuator can be entirely disposed within a chamber defined by a storage member (e.g., in embodiment in which the actuator is a button that, when depressed, moves a membrane from a first configuration to a second configuration).

In the illustrated embodiment, each of the attachment members 20 is attached to the storage member 12 and comprises an elongate member 68 that has a first end 70 and a second end 72. The first end 70 is attached to the storage member 12 and the second end 72 of a first attachment member 74 of the attachment members 20 is sized and configured to mate with the second end 72, or any other portion, of a second attachment member 76 of the attachment members 20 to provide releasable attachment between the attachment members 20. Optionally, attachment members can be omitted from a safety device. For example, in some embodiments, a safety device can include a storage member that defines a channel through which a belt, or other device, can be passed to attach the storage member to an individual. Alternatively, a safety device could be carried by an individual (e.g., held within a hand of an individual).

In use, an axial force is applied to the actuator 18 such that it moves from its first position to its second position resulting in movement of the membrane 14 from the first configuration to the second configuration. In the illustrated embodiment, axial force is applied on the actuator 18 away from the safety device 10 and, as a result of the actuator 18 being directly attached to the membrane 14, the application of a force in this manner, tears the material forming the membrane 14 such that the chamber 40 defined by the membrane 14 is in fluid communication with the chamber 26 defined by the storage member 12 and the environment 30 exterior to the chamber 26. This results in the material 16 disposed within the membrane 14 to be in fluid communication with the environment 30 exterior to the chamber 26 defined by the storage member 12 through the windowed portion 28 defined by the storage member 12, as shown in FIG. 4.

While the safety device 12 has been illustrated and described as attachable to the waist of an individual (e.g., a wearable safety device), a safety device, such as those described herein, can be attached to any suitable portion of an individual. Alternatively, a safety device can comprise a device that is not attachable to an individual and that can be carried by an individual. For example, one or more attachment members included on a safety device can be releasable attached to a storage member such that the storage member can be carried by an individual rather than being attached to the individual.

Alternative embodiments of a safety device can include additional components, features, devices, and/or systems and selection of additional components, features, devices, and/or systems to include in a safety device can be based on various considerations, including the intended use of the safety device of which an additional component, feature, device, and/or system is included. Examples of additional components, features, devices, and/or systems to include in a safety device include one or more sirens, flashlights, GPS locators, combinations of the components, features, devices, and/or systems described herein, and any other component, feature, device, and/or system considered suitable for a particular embodiment.

Figure 5:
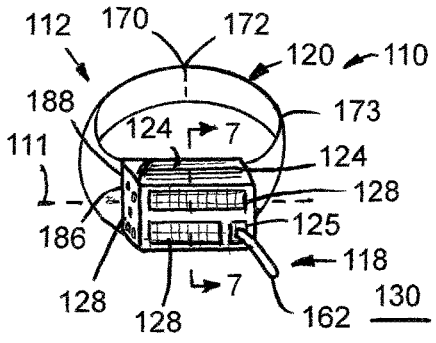
FIG. 5 is a perspective view of a second example safety device in a first configuration.
Figure 6:
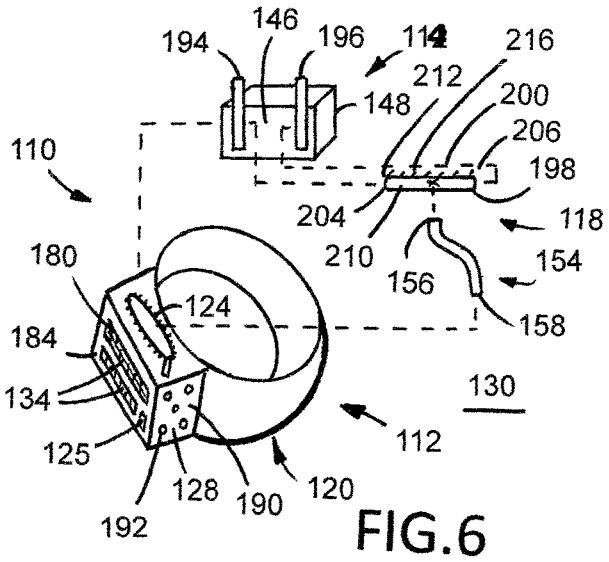
FIG. 6 is an exploded view of the safety device illustrated in FIG. 5.
Figure 7:
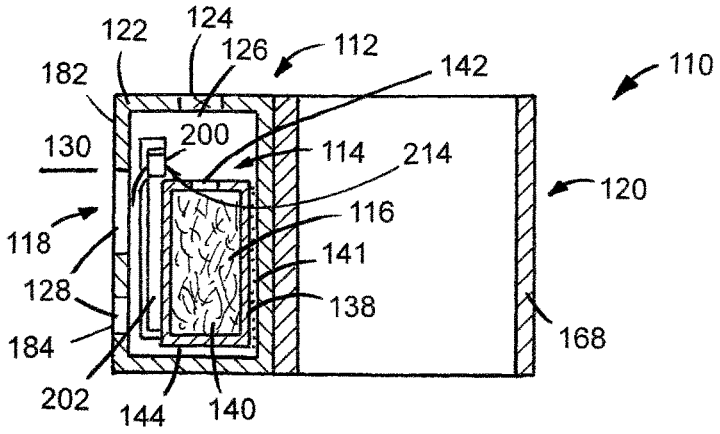
FIG. 7 is a cross-sectional view of the safety device illustrated in FIG. 5 taken along line 7-7.
Figure 8:
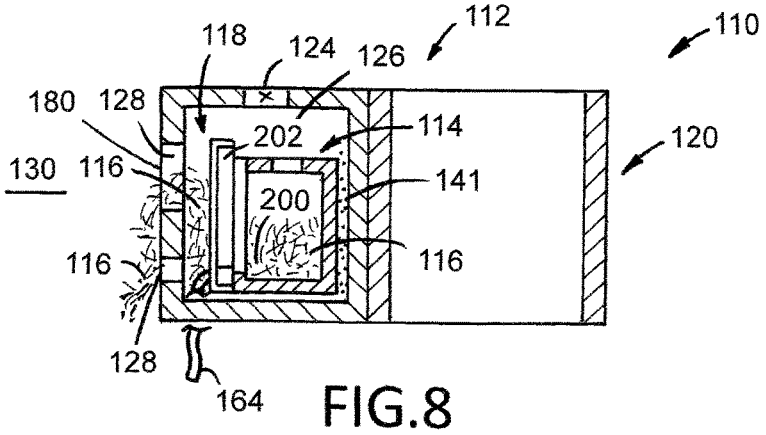
FIG. 8 illustrates the safety device shown in FIG. 7 in a second configuration.

FIGS. 5, 6, 7, and 8 illustrate a second example safety device 110. The safety device 110 is similar to the safety device 10 illustrated in FIGS. 1, 2, 3, and 4 and described above, except as detailed below. The safety device 110 is attachable to an individual and moveable between a first configuration, as shown in FIGS. 5, 6, and 7, and a second configuration, as shown in FIG. 8. The safety device 110 has a lengthwise axis 111, a storage member 112, a membrane 114 disposed within the storage member 112, a material 116 disposed within the membrane 114, an actuator 118, and an attachment member 120. In the illustrated embodiment, the safety device 110 is attachable to the arm of an individual.

In the illustrated embodiment, the main body 122 of the storage member 112 defines a first opening 124, a second opening 125, a chamber 126, and a plurality of windowed portions 128. The first opening 124 is moveable between an open configuration, as shown in FIG. 6, and a closed configuration, as shown in FIGS. 5, 7, and 8. Each windowed portion of the plurality of windowed portions 128 extends through the main body 122 and provides access between the chamber 126 and the environment 130 exterior to the chamber 126. A first windowed portion 180 of the plurality of windowed portions 128 is disposed on a first side 182 of the storage member 112 (e.g., the front face of the storage member 12), a second windowed portion 184 of the plurality of windowed portions 128 is disposed on the first side 182 of the storage member 112, a third windowed portion 186 of the plurality of windowed portions 128 is disposed on a third side 188 of the storage member 112, and a fourth windowed portion 190 of the plurality of windowed portions 128 is disposed on a fourth side 192 of the storage member 112. In the illustrated embodiment, each of the first and second windowed portions 180, 184 is formed as a mesh of material 134 in the material forming the storage member 112 and each of the third and fourth window portions 186, 190 are formed as a plurality of openings extending through the main body 122 of the storage member 112 that include a grommet within each opening of the plurality of openings. The second opening 125 provides access between the chamber 126 and an environment 130 exterior to the chamber 126 and is sized and configured to receive a portion of the actuator 118.

A storage member can have any suitable number of sides and include any suitable number of windowed portions and selection of a suitable number of sides and of a suitable number of windowed portions can be based on various considerations, including the intended use of a safety device of which the storage member is included. Examples of numbers of sides considered suitable to include on a storage member include one, at least one, two, a plurality, three, four, five, six, seven, eight, nine, ten, more than ten, and any other number considered suitable for a particular embodiment. Examples of numbers of windowed portions considered suitable to include on a storage member include one, at least one, two, a plurality, three, four, five, six, seven, eight, nine, ten, more than ten, and any other number considered suitable for a particular embodiment.

In the illustrated embodiment, the membrane 114 has a main body 138, a chamber 140, a top 142, a bottom 144, a first side 146, a second side 148, a first configuration, as shown in FIG. 7, in which the chamber 140 seals the material 116 within the chamber 140, and a second configuration, as shown in FIG. 8, in which the chamber 140 is in fluid communication with the chamber 126 and the environment 130 exterior to the chamber 126. The safety device 110 is in the first configuration when the membrane 114 is in the first configuration and the safety device 110 is in the second configuration when the membrane 114 is in the second configuration. The membrane 114 is directly attached to the main body 122 of the storage member 112 using an adhesive 141. The main body 138 of the membrane 114 is formed of polypropylene and has a cuboidal configuration.

In the illustrated embodiment, the material 116 is disposed within the chamber 140 defined by the membrane 114, is contained within the membrane 114 when the membrane 114 is in the first configuration, and the material 116 is in fluid communication with the chamber 126 and the environment 130 exterior to the membrane 114 when the membrane 114 is in the second configuration. In the illustrated embodiment, the material 116 comprises an irritant that includes a dye.

In the illustrated embodiment, the actuator 118 is directly attached to the membrane 114, is partially disposed within the chamber 126, and is moveable between a first position and a second position such that movement of the actuator 118 from the first position to the second position results in movement of the membrane 114 from its first configuration to its second position. The actuator 118 includes an elongate member 154, a first track 194, a second track 196, a moveable member 198, and a plurality of pins 200. The elongate member 154 has a first end 156 and a second end 158. The first end 156 is directly attached to the moveable member 198, extends from the first end 156, through the second opening 125, and to the second end 158 such that it extends through the second opening 125. Each of the first track 194 and the second track 196 is attached to the membrane 114 and defines a recess 202 sized and configured to receive a portion of the moveable member 198. The moveable member 198 has a first end 204, a second end 206, a front side 210, and a rear side 212. The first end 204 is disposed within the recess 202 defined by the first track 194 and the second end 206 is disposed within the recess 202 defined by the second track 196. Each pin of the plurality of pins 200 has a first end 214 attached to the rear side 212 of the moveable member 198 and a second end 216 that is sharp and sized and configured to puncture the material that forms the membrane 214 as the actuator 118 is moved from the first position to the second position. In the illustrated embodiment, the elongate member 154 is formed of a weaved material, each of the first and second tracks 194, 196 is formed of a polymer, and each pin of the plurality of pins 200 is formed of a metal.

In the first position, the second end 158 of the elongate member 154 is disposed at a first location 162 relative to the lengthwise axis 111 of the safety device 110. In the second position, the second end 158 of the elongate member 154 is disposed at a second location 164 relative to the lengthwise axis 111 of the safety device 110, which is different than the first location 162. In the illustrated embodiment, the first location 162 is disposed a first distance from the storage member 112 and the second location 164 is disposed a second distance from the storage member 112 that is greater than the first distance.

In the illustrated embodiment, the attachment member 120 is attached to the storage member 112 and comprises an elongate member 168 that has a first and second ends 170, 172 attached to one another to form a loop 173. The attachment member 120 is formed of an elastic material such that it can form fit on an individual's arm (e.g., between the elbow and the shoulder) during use.

In use, an axial force is applied to the elongate member 154 of the actuator 118 away from the safety device 110 such that it moves from its first position to its second position resulting in movement of the membrane 114 from the first configuration to the second configuration. In the illustrated embodiment, the application of a force in this manner results in movement of the moveable member 198 toward the bottom 144 of the membrane 114 such that the plurality of pins 200 puncture the material forming the membrane 114 and the chamber 140 defined by the membrane 114 is in fluid communication with the chamber 126 defined by the storage member 112 and the environment 130 exterior to the chamber 126. This results in the material 116 disposed within the membrane 114 to be in fluid communication with the environment 130 exterior to the chamber 126 defined by the storage member 112 through the plurality of windowed portions 128 defined by the storage member 112.

Figure 10:
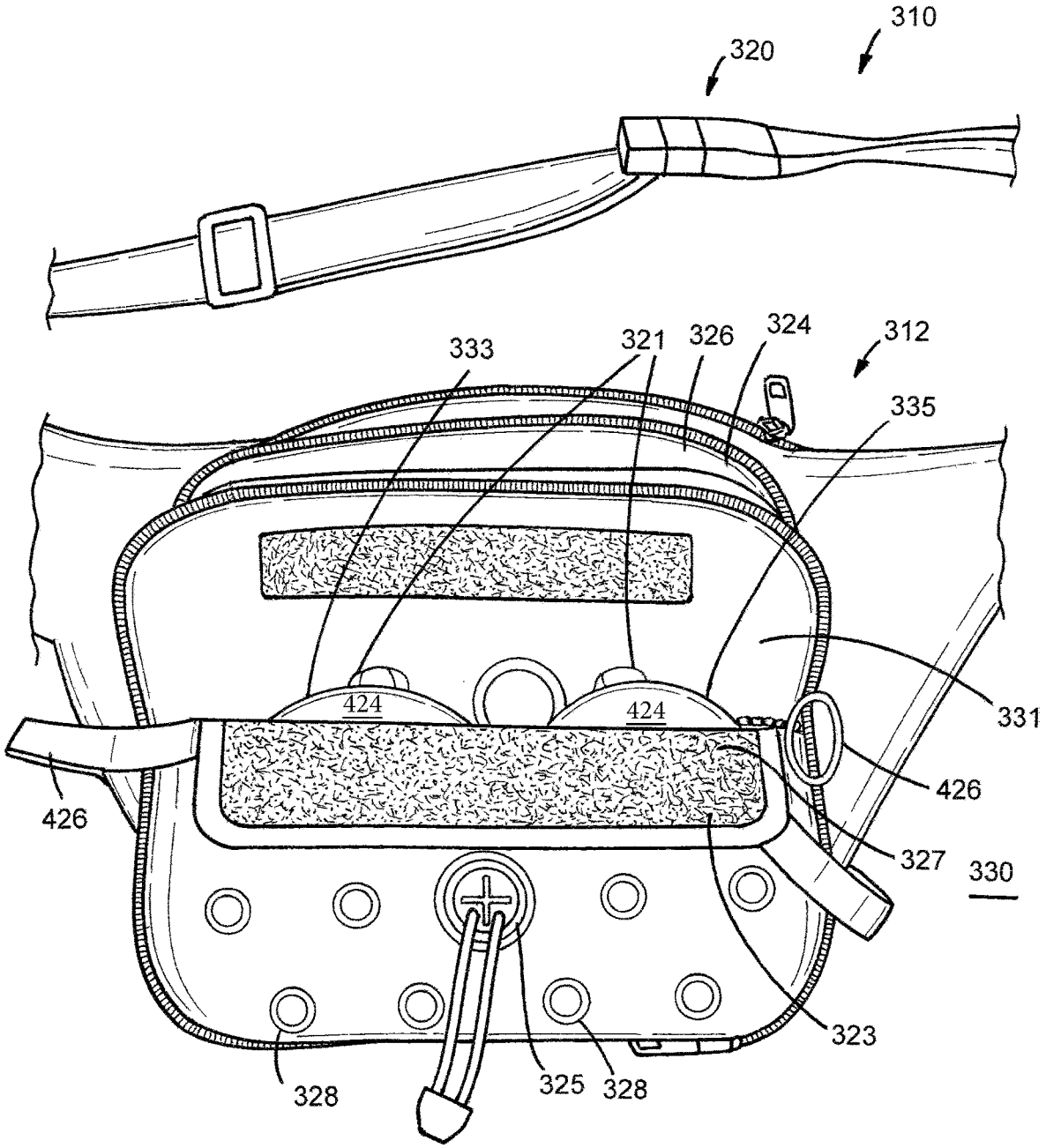
FIG. 10 is another partial front view of the safety device illustrated in FIG. 9. The third opening is illustrated in the open configuration.
Figure 11:
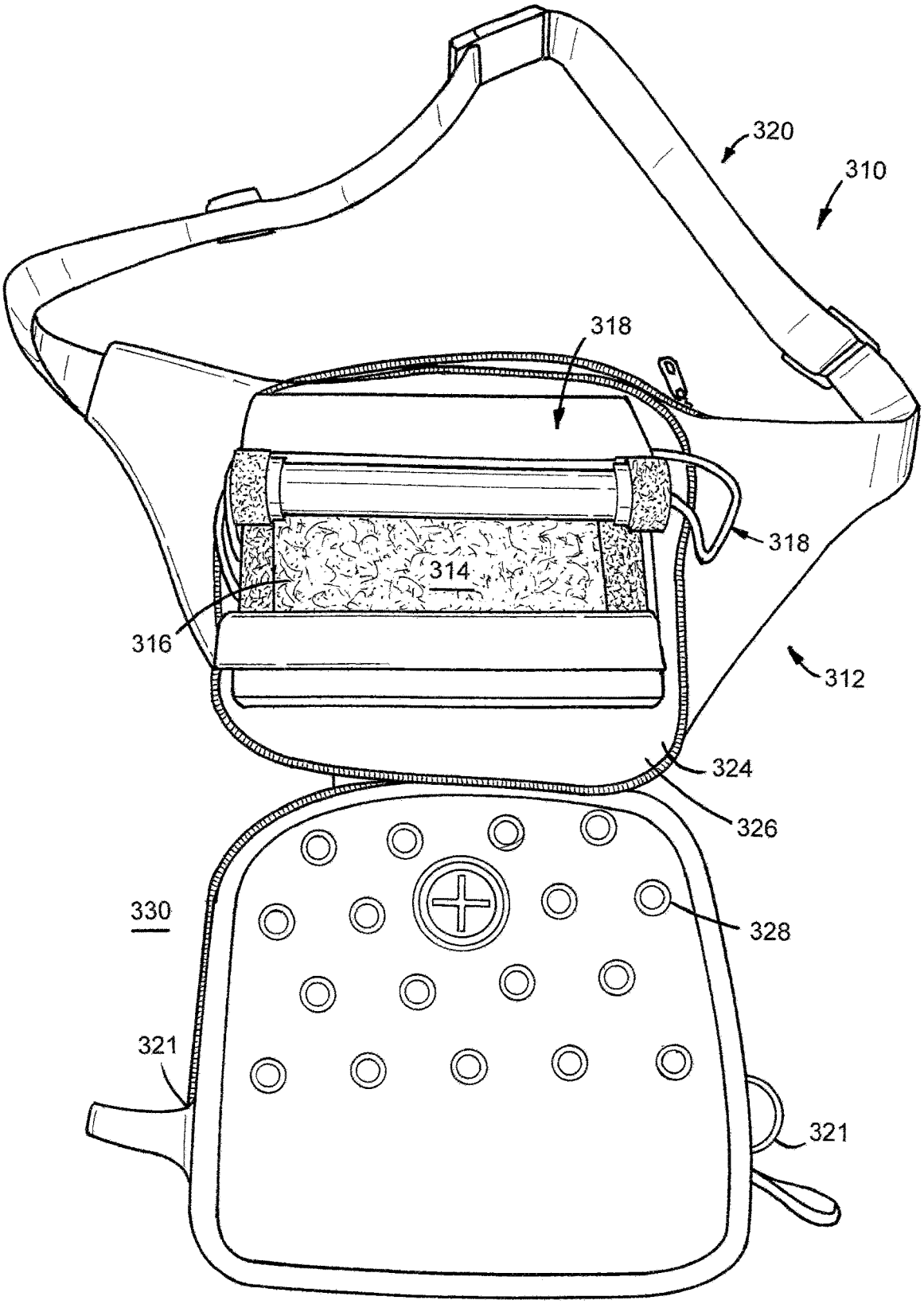
FIG. 11 is another partial front view of the safety device illustrated in FIG. 9. The first opening is illustrated in the open configuration.
Figure 12:
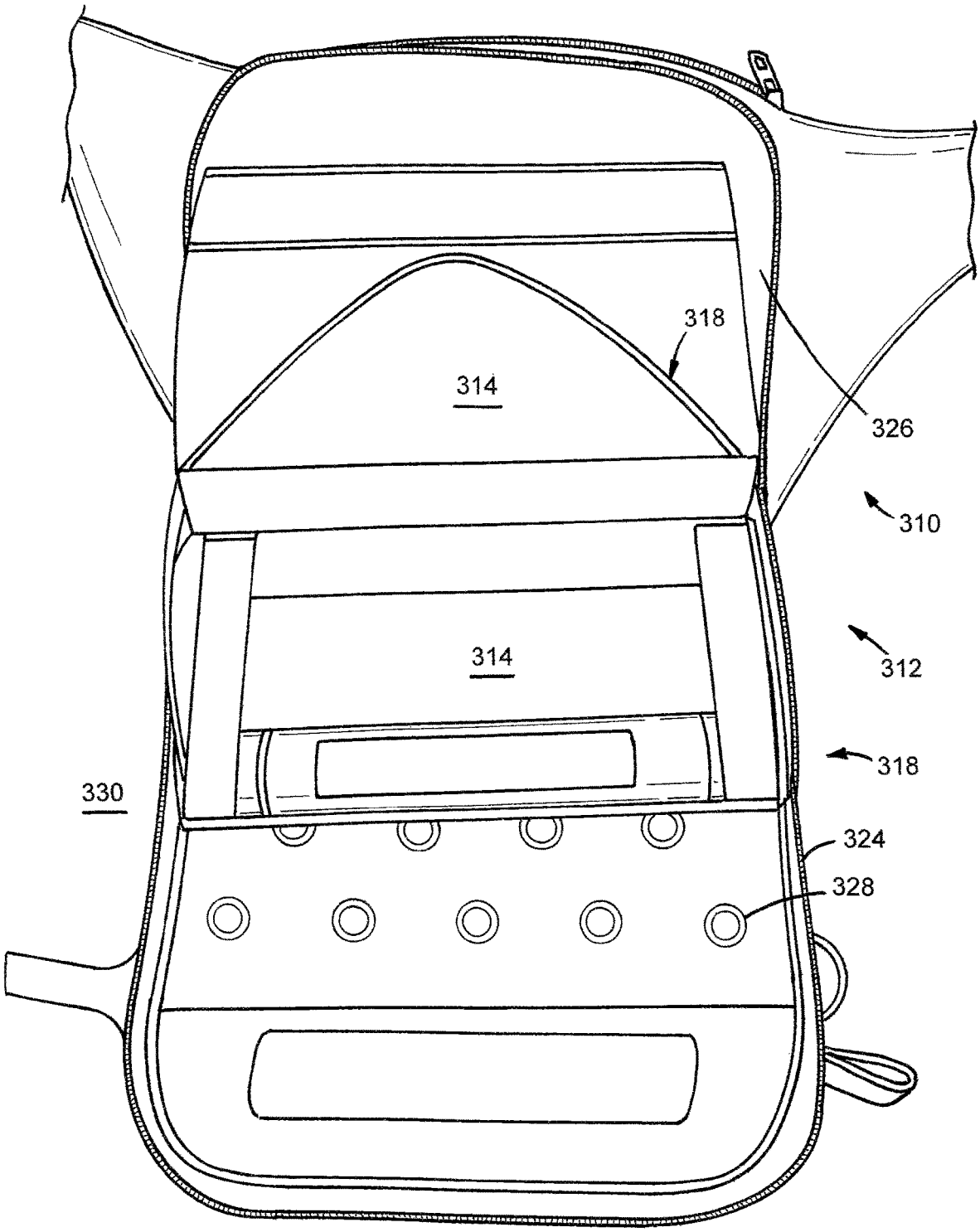
FIG. 12 is another partial front view of the safety device illustrated in FIG. 9. The first opening is illustrated in the open configuration and the membrane is illustrated in the second configuration.
Figure 13:
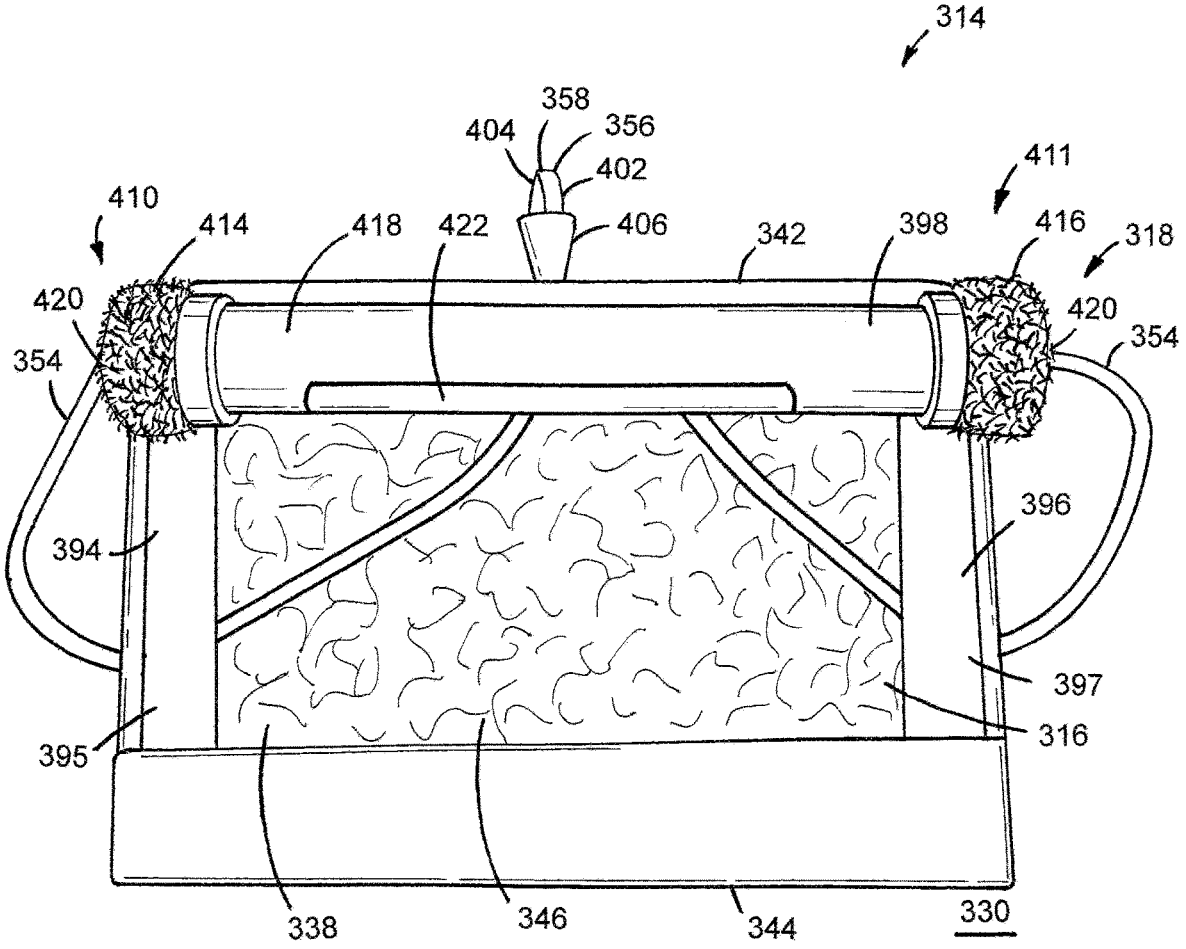
FIG. 13 is a front view of the membrane and actuator free of the storage member illustrated in FIG. 9. The actuator is in the first position and the membrane is in the first configuration.
Figure 14:
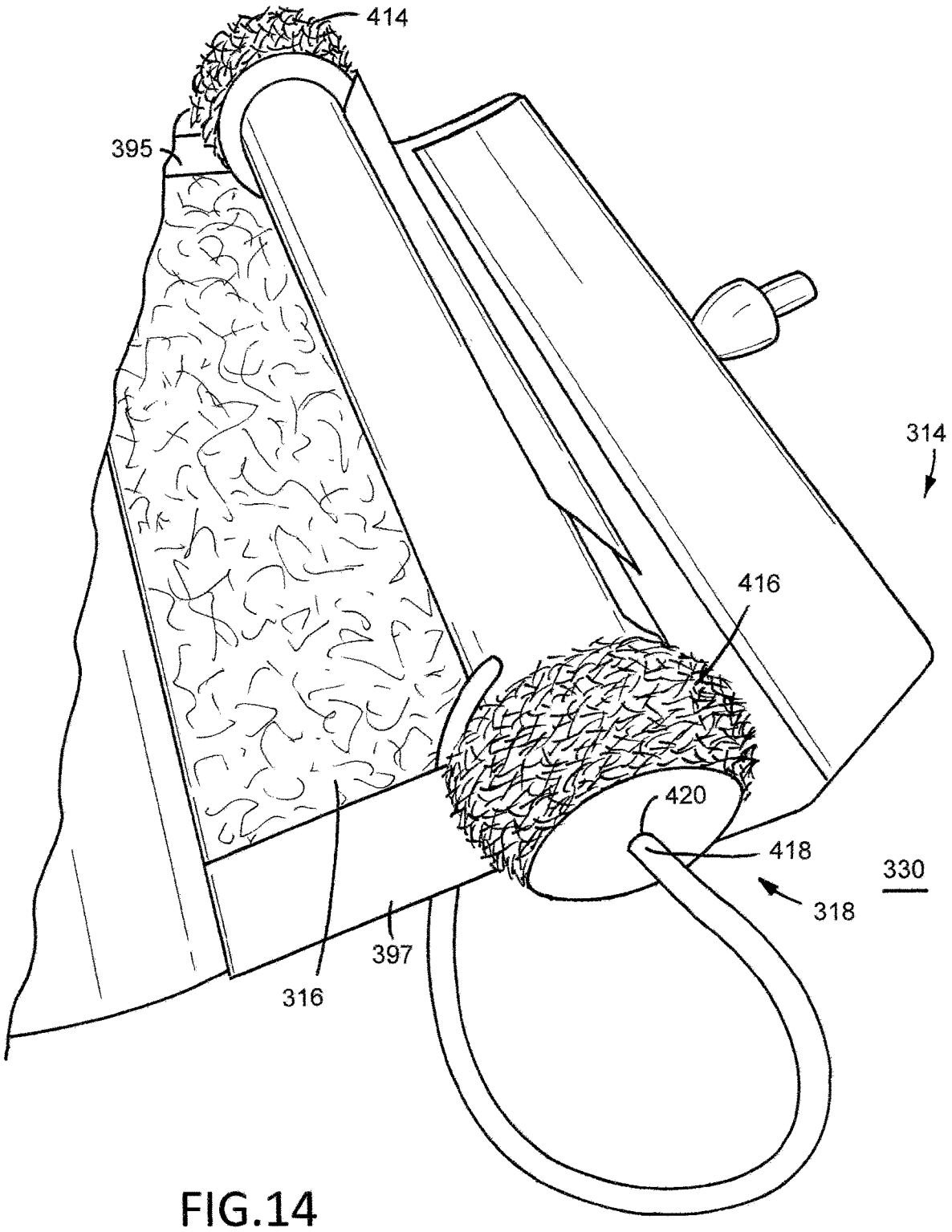
FIG. 14 is a partial perspective view of the membrane and actuator shown in FIG. 13.
Figure 15:
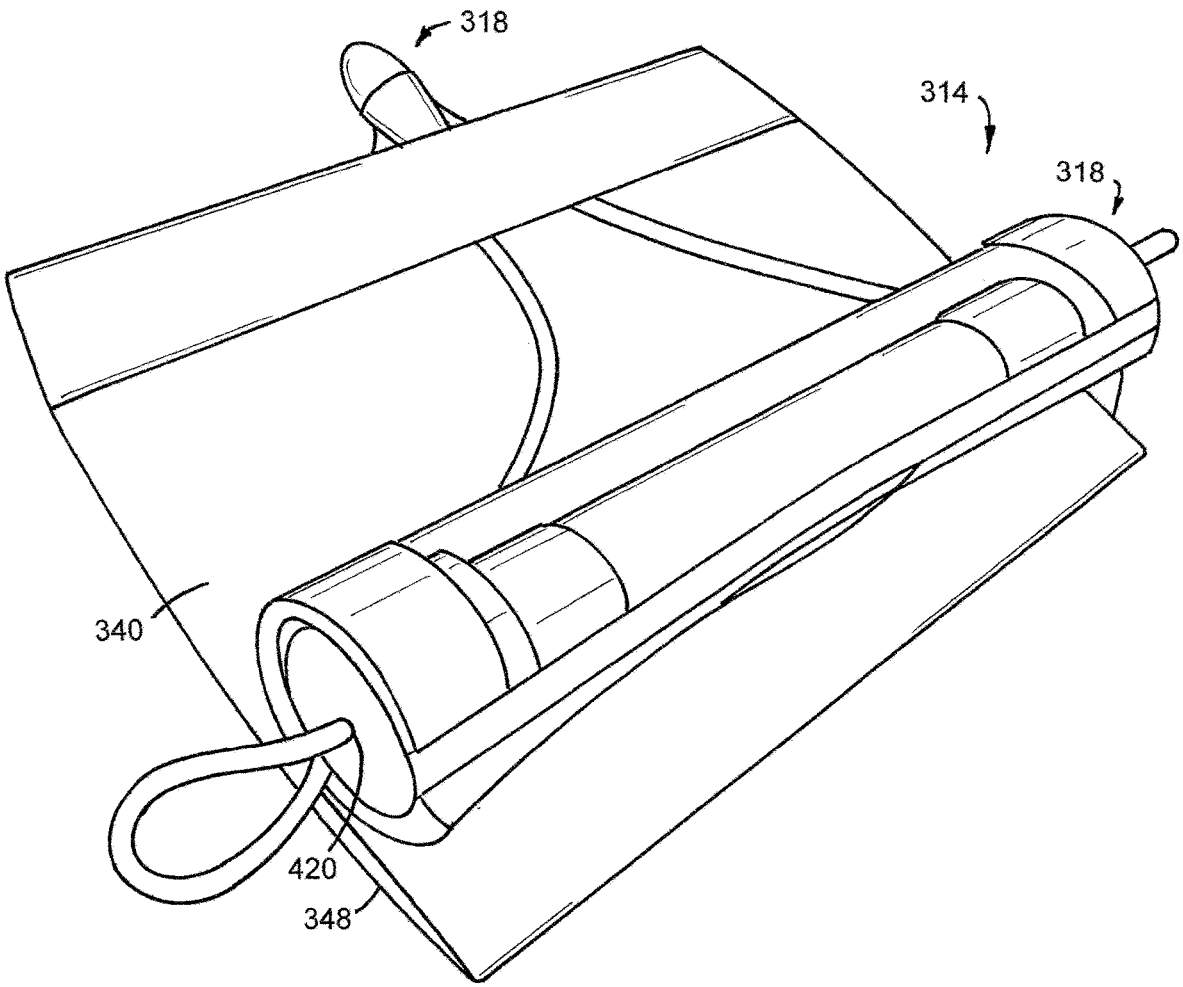
FIG. 15 is another perspective view of the membrane and actuator shown in FIG. 13. The actuator is in the second position and the membrane is in the second configuration.

FIGS. 9, 10, 11, 12, 13, 14, and 15 illustrate a third example safety device 310. The safety device 310 is similar to the safety device 10 illustrated in FIGS. 1, 2, 3, and 4 and described above, except as detailed below. The safety device 310 is attachable to an individual and moveable between a first configuration, as shown in FIGS. 9, 10, 11, 13, and 14 and a second configuration, as shown in FIGS. 12 and 15. The safety device 310 has a lengthwise axis 311, a storage member 312, a membrane 314 disposed within the storage member 312, a material 316 disposed within the membrane 314, an actuator 318, an attachment member 320, and a plurality of sirens 321. In the illustrated embodiment, the safety device 310 is attachable to the waist of an individual.

Figure 9:
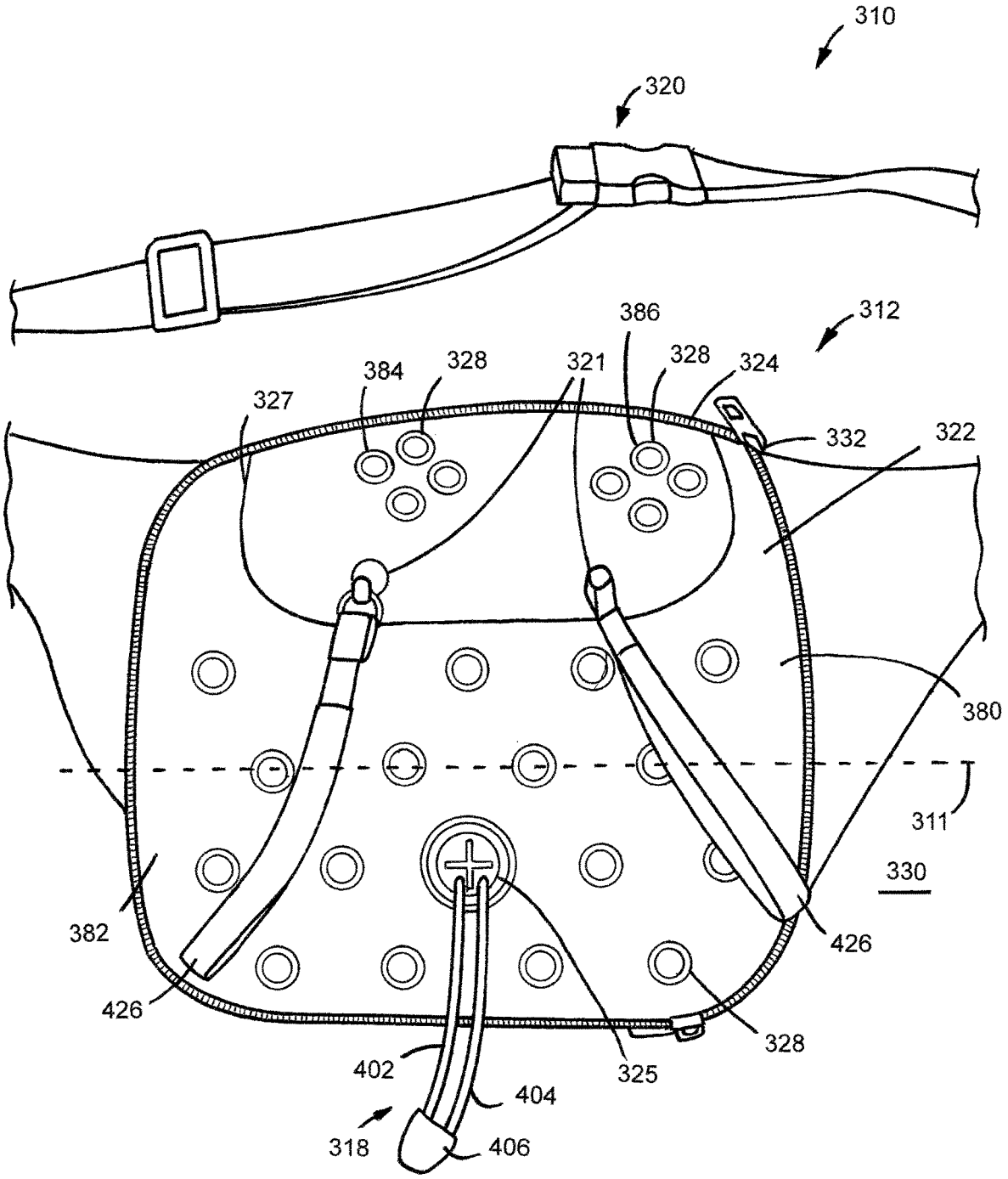
FIG. 9 is a partial front view of a third example safety device in a first configuration.

In the illustrated embodiment, the main body 322 of the storage member 312 defines a first opening 324, a second opening 325, a first chamber 326, a third opening 327, a plurality of windowed portions 328, a second chamber 331, a fourth opening 333, and a fifth opening 335. The first opening 324 is moveable between open and closed configurations using a zipper 332 attached to the storage member 312. The third opening 327 is moveable between open and closed configurations using a hook and loop fasteners 323 attached to the storage member 312. The first opening 324 provides access between the first chamber 326 and an environment 330 exterior to the first chamber 326. The first opening 324 is sized and configured to allow the membrane 314 to be passed through the first opening 324 from the environment 330 exterior to the first chamber 326 and into the first chamber 326. The first opening 324 is moveable between an open configuration, as shown in FIGS. 10, 11, and 12, and a closed configuration, as shown in FIG. 9.

The second opening 325 provides access between the first chamber 326 and an environment 330 exterior to the first chamber 326. The second opening 325 is sized and configured to allow a portion of the actuator 318 to be passed from the first chamber 326, through the second opening 325, and to the environment 330 exterior to the first chamber 326. The first chamber 326 is sized and configured to receive the membrane 314 and a portion of the actuator 318.

The third opening 327 provides access between the second chamber 331 and an environment 330 exterior to the second chamber 331. The third opening 327 is sized and configured to allow the plurality of sirens 321 to be passed through the third opening 327 from the environment 330 exterior to the second chamber 331 and into the second chamber 331. The third opening 327 is moveable between an open configuration, as shown in FIG. 10, and a closed configuration, as shown in FIG. 9. Each of the fourth opening 333 and the fifth opening 335 is sized and configured to receive a portion of a siren of the plurality of sirens 321 such that each of the sirens 321 can be stored within the second chamber 331.

Each windowed portion of the plurality of windowed portions 328 extends through the main body 322 and provides access between a chamber 326, 331 and the environment 330 exterior to the chamber 326, 331. A first windowed portion 380 of the plurality of windowed portions 328 is disposed on a first side 382 of the storage member 312 (e.g., the front face of the storage member 312), a second windowed portion 384 of the plurality of windowed portions 328 is disposed on the first side 382 of the storage member 312, and a third windowed portion 386 of the plurality of windowed portions 328 is disposed on the first side 382 of the storage member 312. In the illustrated embodiment, each of the first windowed portion 380, the second windowed portion 384, and the third windowed portion 386 is formed as a plurality of openings extending through the main body 322 of the storage member 312. Each opening of the plurality of openings includes a grommet disposed within the opening. The first windowed portion 380 provides access between the first chamber 326 and the environment 330 exterior to the first chamber 326. Each of the second windowed portion 384 and the third windowed portion 386 provides access between the second chamber 331 and the environment 330 exterior to the second chamber 331.

In the illustrated embodiment, the membrane 314 has a main body 338, a chamber 340, a top 342, a bottom 344, a first side 346, a second side 348, a first configuration, as shown in FIGS. 11, 13, and 14, in which the chamber 340 seals the material 316 within the chamber 340, and a second configuration, as shown in FIGS. 12 and 15, in which the chamber 340 is in fluid communication with the first chamber 326 and the environment 330 exterior to the first chamber 326. The safety device 310 is in the first configuration when the membrane 314 is in the first configuration and the safety device 310 is in the second configuration when the membrane 314 is in the second configuration. The membrane 314 is releasably attached to the main body 322 of the storage member 312 using hook and loop fasteners such that the membrane 314 can be removed from the storage member 312 and replaced with a new membrane, when desired. The main body 338 of the membrane 314 is formed of a transparent low density polyethylene and has a cuboidal configuration.

In the illustrated embodiment, the material 316 is disposed within the chamber 340 defined by the membrane 314, is contained within the membrane 314 when the membrane 314 is in the first configuration, and the material 316 is in fluid communication with the first chamber 326 and the environment 330 exterior to the membrane 314 when the membrane 314 is in the second configuration. In the illustrated embodiment, the material 316 comprises an irritant that includes a dye.

In the illustrated embodiment, the actuator 318 is moveably, and releasably, attached to the membrane 314, is partially disposed within the chamber 326, and is moveable between a first position and a second position such that movement of the actuator 318 from the first position to the second position results in movement of the membrane 314 from its first configuration to its second position. The actuator 318 includes an elongate member 354, a first track 394, a second track 396, and a moveable member 398. The elongate member 354 has a first end 356 and a second end 358. A first portion 402 of the elongate member 354 is attached to a second portion 404 of the elongate member 354 using a cap 406, as shown in FIGS. 9 and 13. The elongate member 354 is moveably attached to the moveable member 398 and extends from the first end 356, through the cap 406, through the second opening 325, through a passageway 420 defined by the moveable member 398, as described in more detail herein, through the second opening 325, through the cap 406, and to the second end 358. Each of the first track 394 and the second track 396 is attached to the membrane 314 and comprises a first hook and loop fastener 395 and a second hook and loop fastener 397. Each of the first hook and loop fastener 395 and the second hook and loop fastener 397 is sized and configured to mate with the hook and loop fastener 414, 416 of the moveable member 398, as described in more detail herein.

The moveable member 398 has a first end 410, a second end 411, a first hook and loop fastener 414, a second hook and loop fastener 416, and a main body 418 that defines a passageway 420, and a slot 422. The first hook and loop fastener 414 is attached to the first hook and loop fastener 395 and the second hook and loop fastener 416 is attached to the second hook and loop fastener 397. The passageway 420 extends through the moveable member 398 and is sized and configured to receive a portion of the elongate member 354. The slot 422 extends into the main body 418 and is sized and configured to receive a portion of the first side 346 of the membrane 314.

In the first position, each of the first end 356 and the second end 358 of the elongate member 354 is disposed at a first location relative to the lengthwise axis 311 of the safety device 310. In the second position, each of the first end 356 and the second end 358 of the elongate member 354 is disposed at a second location relative to the lengthwise axis 311 of the safety device 310, which is different than the first location. In the illustrated embodiment, the first location is disposed a first distance from the storage member 312 and the second location is disposed a second distance from the storage member 312 that is greater than the first distance.

In the illustrated embodiment, each siren of the plurality of sirens 321 is disposed within the second chamber 331 and comprises housing 424 and an actuator 426. Each siren of the plurality of sirens 321 is moveable between an off state when the actuator 426 is attached to the housing 424 and an on state when the actuator 426 is removed from the housing 424. In the off state, each siren of the plurality of sirens 321 is silent. In the on state, each siren of the plurality of sirens 321 produces sound (e.g., sound that is irritating to a human ear). While a plurality of sirens 321 have been illustrated as being included in safety device 310, any suitable number of sirens can be included in a safety device and can emit any suitable sound at any suitable intensity. Examples of numbers of sirens considered suitable to include in a safety device include one, at least one, two, a plurality, three, four, more than four, and any number considered suitable for a particular embodiment.

In use, an axial force is applied to the elongate member 354 of the actuator 318 away from the safety device 310 such that it moves from its first position to its second position resulting in movement of the membrane 314 from the first configuration to the second configuration. In the illustrated embodiment, the application of a force in this manner results in rotational movement of the moveable member 398 toward the bottom 344 of the membrane 314 such that the portion of the first side 346 of the membrane 314 disposed within the slot 422 is pulled toward the bottom 344 of the membrane 314 while the second side 348 of the membrane 314 remains attached to the storage member 312. This results in the membrane 314 tearing along the seams between the first side 346 and the second side 348 and the chamber 340 defined by the membrane 314 being in fluid communication with the chamber 326 defined by the storage member 312 and the environment 330 exterior to the chamber 326. This results in the material 316 disposed within the membrane 314 being in fluid communication with the environment 330 exterior to the chamber 326 defined by the storage member 312 through the first windowed portion 380 defined by the storage member 312. In use, if desired, an individual can remove the actuator 426 attached to a first siren of the plurality of sirens 321 and/or the actuator 426 attached to a second siren of the plurality of sirens 321 to move the siren to the on state.

Figure 16:
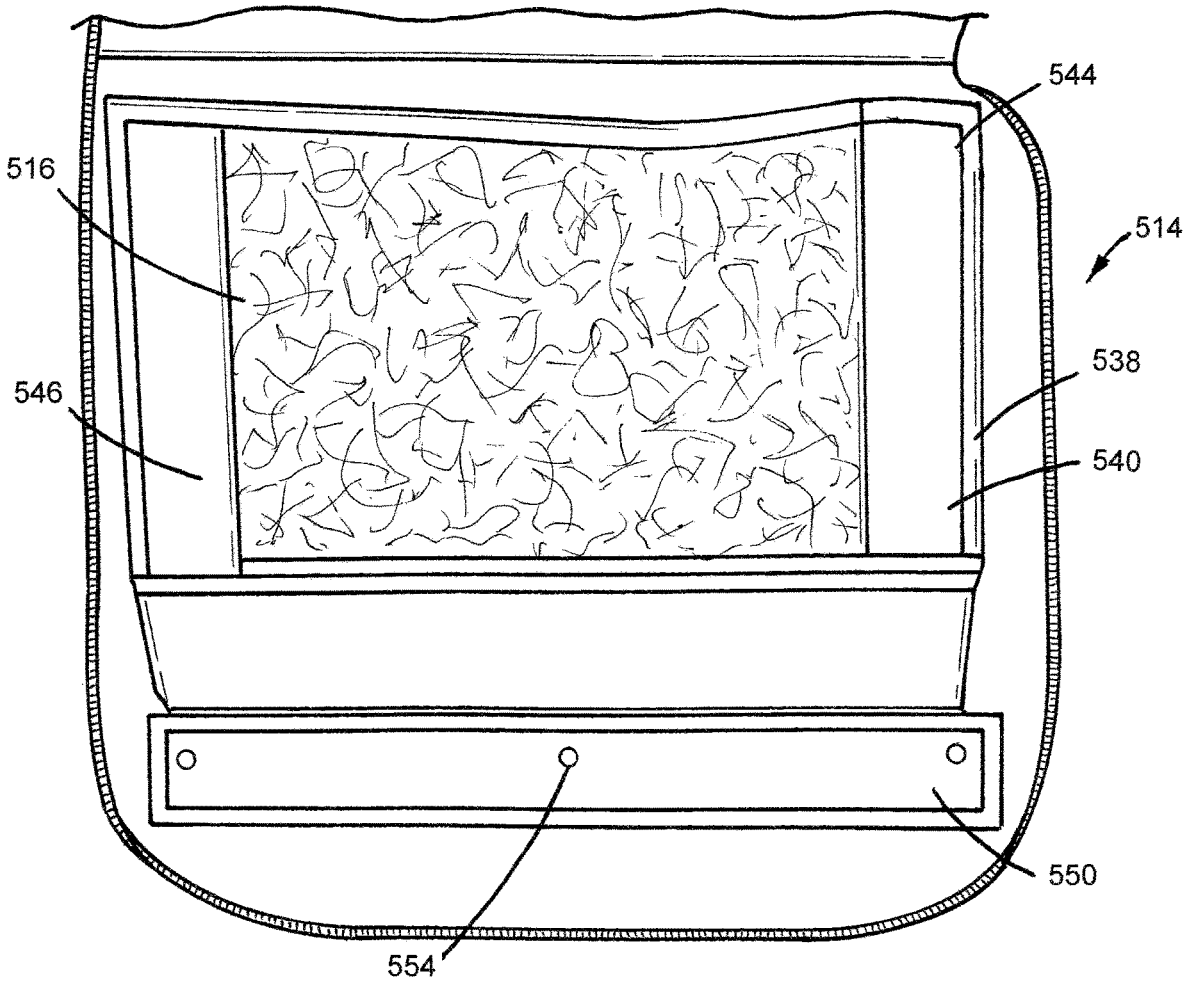
FIG. 16 is a partial front view of an example alternative membrane that can be included in a safety device.
Figure 17:
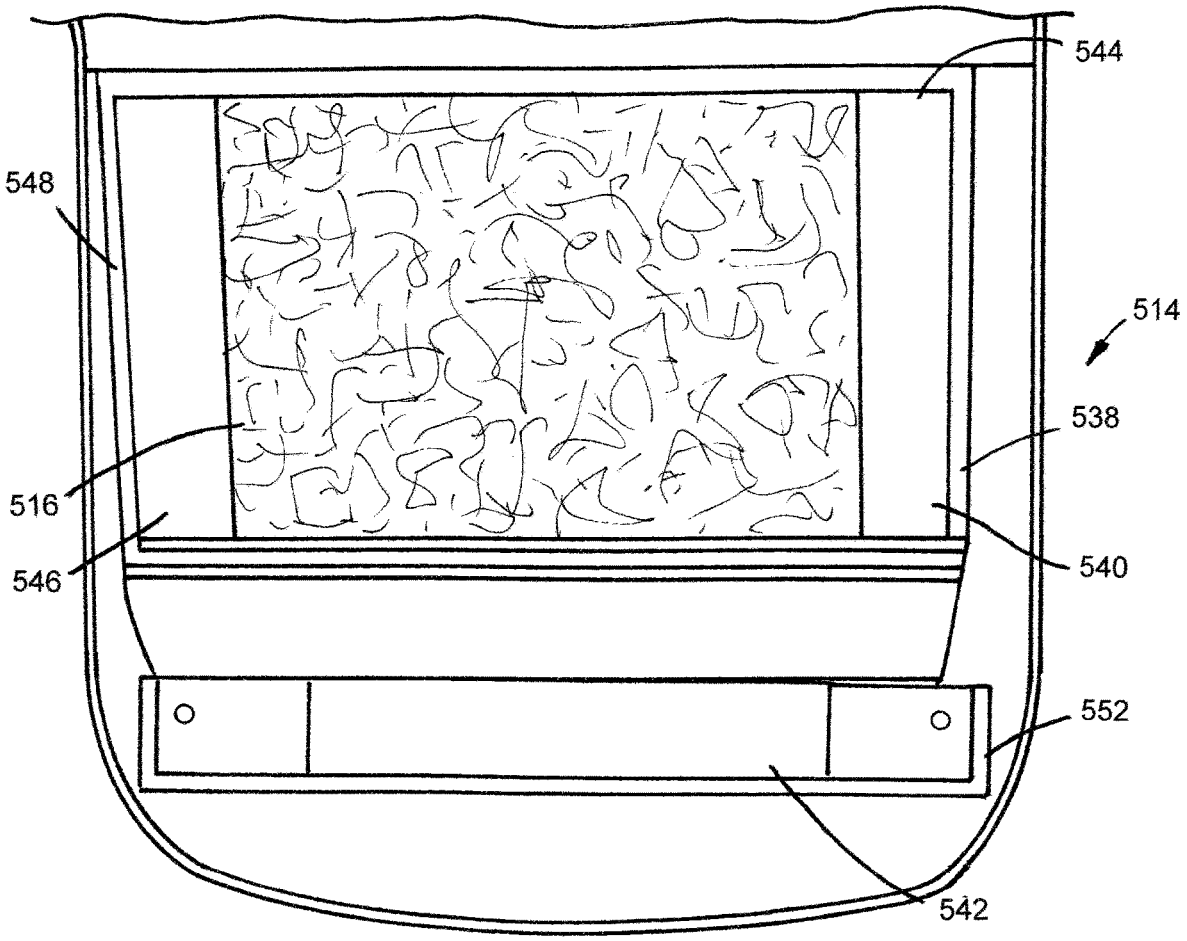
FIG. 17 is another partial front view of the membrane illustrated in FIG. 16 with the first elongate member removed.

FIGS. 16 and 17 illustrate an example alternative membrane 514 that can be included in a safety device, such as those described herein. The membrane 514 is similar to the membrane 314 illustrated in FIGS. 9, 10, 11, 12, 13, 14, and 15 and described above, except as detailed below.

In the illustrated embodiment, the membrane 514 has a main body 538, a chamber 540, a top 542, a bottom 544, a first side 546, a second side 548, a first configuration, as shown in FIGS. 16 and 17, in which the chamber 540 seals the material 516 within the chamber 540, and a second configuration in which the chamber 540 is in fluid communication with a chamber defined by a storage member and an environment exterior to the chamber defined by the storage member. The top 542 of the first side 546 is attached to a first elongate member 550 and the top 542 of the second side 548 is attached to a second elongate member 552. Each of the first elongate member 550 and the second elongate member 552 defines a plurality of openings 554 that extend through the relative elongate member. Each opening of the plurality of openings 554 that extends through the first elongate member 550 provides a mechanism to attach the first elongate member 550 to a portion of an actuator (e.g., moveable member). Each opening of the plurality of openings 554 that extends through the second elongate member 552 provides a mechanism to attach the second elongate member 552 to a portion of a storage member.

Various methods of using a safety device are described herein. While the methods described herein are shown and described as a series of acts, it is to be understood and appreciated that the methods are not limited by the order of acts, as some acts may, in accordance with these methods, be omitted, occur in the order shown and/or described, occur in different orders with other acts described herein, and/or occur concurrently with other acts described herein. The methods described herein include methods of using a safety device.

Figure 18:
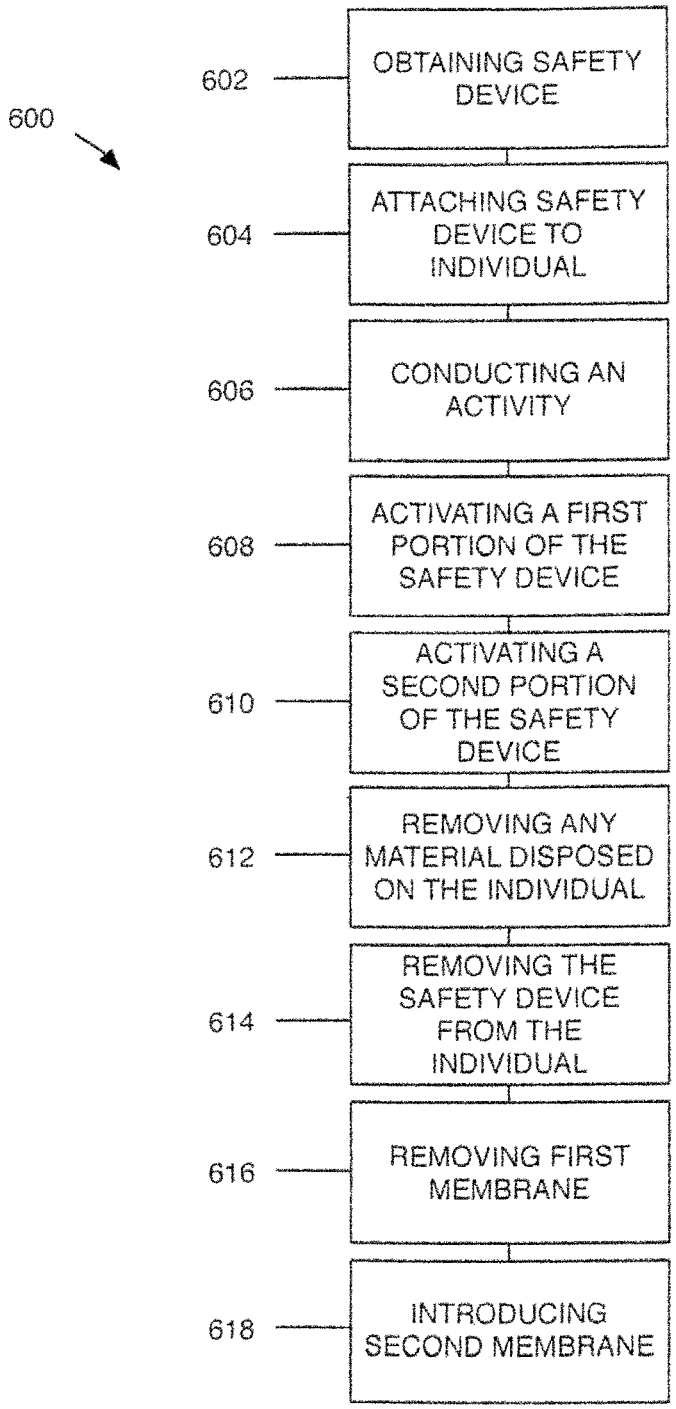
FIG. 18 is a schematic illustration of an example method of using a safety device.

FIG. 18 is a schematic illustration of an example method 600 of using a safety device.

A step 602 comprises obtaining a safety device. Another step 604 comprises attaching the safety device to an individual. Another step 606 comprises conducting an activity. Another step 608 comprises activating a first portion of the safety device. Another step 610 comprises activating a second portion of the safety device. Another step 612 comprises removing any material disposed on the individual subsequent to the step of activating the first portion of the safety device. Another step 614 comprises removing the safety device from the individual. Another step 616 comprises removing a first membrane from the safety device. Another step 618 comprises introducing a second membrane into the safety device.

Step 602 can be accomplished by obtaining any suitable safety device and selection of a suitable safety device can be based on various considerations, including the intended use of the safety device. Examples of safety devices considered suitable to use to complete method 600, and any other method described herein, include safety device 10, safety device 110, safety device 310, variations of the safety device described herein, and any other safety device considered suitable for a particular embodiment.

Step 604 can be accomplished by attaching the safety device obtained in step 602 to any suitable portion of an individual and selection of a suitable portion of an individual to attach a safety device can be based on various considerations, including the size, shape, and/or configuration of a safety device intended to be attached to the individual. Examples of portions of an individual considered suitable to attach a safety device include a waist of an individual, an arm of an individual, a portion of an arm of an individual disposed between an elbow and shoulder, a portion of an arm of an individual disposed between an elbow and a wrist, a portion of a leg, a portion of a leg of an individual disposed between a knee and an ankle, a portion of a leg of an individual disposed between a knee and a waist, and any other portion considered suitable for a particular embodiment. Alternatively, step 604 can comprise holding the safety device obtained in step 602 (e.g., in the hand).

Step 606 can be accomplished by conducting any suitable activity and selection of a suitable activity to conduct while wearing or holding a safety device can be based on various considerations, including the size, shape, and/or configuration of a safety device intended to be worn or held by the individual. Examples of activities considered suitable to complete while a safety device is attached or held by an individual include jogging, walking, playing a sport, and any other activity considered suitable for a particular embodiment. Optionally, step 606 can be omitted from a method of using a safety device.

Step 608 can be accomplished using any technique or method of activating a first portion of a safety device. A first portion of a safety device can comprise any suitable portion of a safety device, such as a membrane or a siren. Examples of techniques and methods considered suitable to activate a first portion of a safety device include moving an elongate member of an actuator from a first position to a second position, removing an actuator attached to a siren from the housing of the siren, and any other technique or method considered suitable for a particular embodiment. In method 600, step 608 comprises moving a membrane from a first configuration to a second configuration.

Step 610 can be accomplished using any technique or method of activating a second portion of a safety device, which is different than the first portion. A second portion of a safety device can comprise any suitable portion of a safety device, such as a membrane or a siren. Examples of techniques and methods considered suitable to activate a second portion of a safety device include moving an elongate member of an actuator from a first position to a second position, removing an actuator attached to a siren from the housing of the siren, and any other technique or method considered suitable for a particular embodiment. Optionally, step 610 can be omitted from a method of using a safety device. Alternatively, step 610 can be accomplished concurrently with step 608. In method 600, step 610 comprises activating a siren.

Step 612 can be accomplished using any suitable technique or method of removing a material disposed on the individual subsequent to moving the membrane to the second configuration and selection of a suitable technique or method can be based on various considerations, including the type of material disposed on the individual. Examples of techniques and methods considered suitable to remove a material from an individual include using a cleaning material, using washing solution, and any other technique or method considered suitable for a particular embodiment. Step 612 can be completed subsequent to step 608 and/or subsequent to step 610, step 614, step 616, and/or step 618.

Step 614 can be accomplished using any suitable technique or method of removing the safety device from the individual.

Step 616 can be accomplished using any suitable technique or method of removing a first membrane from a safety device and selection of a suitable technique or method can be based on various considerations, including the type of attachment between a membrane and a storage member.

Step 618 can be accomplished using any suitable technique or method of introducing a second membrane into a safety device and selection of a suitable technique or method can be based on various considerations, including the type of attachment between a membrane and a storage member. An optional step comprises attaching (e.g., releasably, permanently) the second membrane to a storage member.

Those with ordinary skill in the art will appreciate that various modifications and alternatives for the described and illustrated embodiments can be developed in light of the overall teachings of the disclosure. Accordingly, the particular arrangements disclosed are intended to be illustrative only and not limiting as to the scope of the invention, which is to be given the full breadth of the appended claims and any and all equivalents thereof.

What is claimed is:

1. A safety device comprising:

a storage member having a main body defining a first opening, a chamber, and a windowed portion, the first opening providing access between the chamber and an environment exterior to the chamber, the windowed portion extending through the main body and providing access between the chamber and the environment exterior to the chamber;

a membrane disposed within the chamber and having a first configuration and a second configuration;

a material disposed within the membrane, the material contained within the membrane when the membrane is in the first configuration and the material in fluid communication with the environment exterior to the chamber when the membrane is in the second configuration; and an actuator attached to the membrane, disposed within the chamber, and moveable between a first position and a second position such that movement of the actuator from the first position to the second position results in movement of the membrane from the first configuration to the second configuration;

wherein the windowed portion defines a plurality of openings extending through the main body.

2. The safety device of claim 1, wherein the membrane is releasably attached to the main body of the storage member.

3. The safety device of claim 1, wherein the material comprises an irritant.

4. A safety device comprising:

a storage member having a main body defining a first opening, a chamber, and a windowed portion, the first opening providing access between the chamber and an environment exterior to the chamber, the windowed portion extending through the main body and providing access between the chamber and the environment exterior to the chamber;

a membrane disposed within the chamber and having a first configuration and a second configuration;

a material disposed within the membrane, the material contained within the membrane when the membrane is in the first configuration and the material in fluid communication with the environment exterior to the chamber when the membrane is in the second configuration; and an actuator attached to the membrane, disposed within the chamber, and moveable between a first position and a second position such that movement of the actuator from the first position to the second position results in movement of the membrane from the first configuration to the second configuration;

wherein the windowed portion comprises a mesh of material.

5. The safety device of claim 4, wherein the membrane is entirely disposed within the chamber.

6. The safety device of claim 4, wherein said safety device is attachable to an individual.

7. The safety device of claim 4, wherein the membrane is releasably attached to the main body of the storage member.

8. The safety device of claim 4, wherein the main body of the storage member defines a second opening providing access between the chamber and the environment exterior to the chamber; and wherein the actuator extends through the second opening.

9. The safety device of claim 8, wherein actuator includes and elongate member that has a first end and a second end, the first end attached to the membrane, the elongate member extending from the first end, through the second opening, to the second end.

10. The safety device of claim 8, wherein the actuator includes a moveable member attached to the membrane and moveable between a first position and a second position, the moveable member in the first position when the actuator is in the first position, the moveable member in the second position when the actuator is in the second position.

11. The safety device of claim 10, wherein the moveable member is releasably attached to the membrane.

12. The safety device of claim 4, wherein the material comprises a pressurized material.

13. The safety device of claim 4, wherein the material comprises an irritant.

14. The safety device of claim 4, wherein the material includes a dye.

15. The safety device of claim 4, wherein the material is a volatile material.

16. The safety device of claim 4, further comprising a siren attached to the main body and moveable between a first configuration in which the siren is in an off state and a second configuration in which the siren is in an on state and produces sound.

17. The safety device of claim 4, wherein movement of the actuator from the first position to the second position results in puncturing of the membrane such that it moves from the first configuration to the second configuration.

18. The safety device of claim 4, wherein the actuator is partially disposed within the chamber.

19. The safety device of claim 4, wherein the membrane has a membrane main body formed of a rigid material.

20. A safety device comprising:

a storage member having a main body defining a first opening, a chamber, and a windowed portion, the first opening providing access between the chamber and an environment exterior to the chamber, the windowed portion extending through the main body and providing access between the chamber and the environment exterior to the chamber;

a membrane disposed within the chamber and having a first configuration and a second configuration;

a material disposed within the membrane, the material contained within the membrane when the membrane is in the first configuration and the material in fluid communication with the environment exterior to the chamber when the membrane is in the second configuration; and an actuator attached to the membrane, disposed within the chamber, and moveable between a first position and a second position such that movement of the actuator from the first position to the second position results in movement of the membrane from the first configuration to the second configuration;

wherein the actuator is directly attached to the membrane and movement of the actuator from the first position to the second position results in tearing of the membrane such that it moves from the first configuration to the second configuration.

* * * * *